US009433042B2

(12) United States Patent
Nankil et al.

(10) Patent No.: US 9,433,042 B2
(45) Date of Patent: Aug. 30, 2016

(54) HIGH-END TRIM CONTROL OF LIGHTING FIXTURES

(71) Applicant: Hubbell Incorporated, Shelton, CT (US)

(72) Inventors: Robert R. Nankil, Fullerton, CA (US); Pritam Yadav, Greenville, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/563,652

(22) Filed: Dec. 8, 2014

(65) Prior Publication Data

US 2016/0165681 A1 Jun. 9, 2016

(51) Int. Cl.
*H05B 33/08* (2006.01)

(52) U.S. Cl.
CPC ..... *H05B 33/0809* (2013.01); *H05B 33/0845* (2013.01)

(58) Field of Classification Search
CPC ..... Y10T 307/944; Y10T 307/937; Y10T 307/858; Y10T 307/382; Y10T 307/76; H05B 33/0815; H05B 33/0818; H05B 33/0803
USPC ..... 307/140, 139, 130, 126, 115; 315/291, 315/307, 312, 360
See application file for complete search history.

(56) References Cited

U.S. PATENT DOCUMENTS 6,842,007 B2 * 1/2005 Butler, Jr. ..... F02P 3/051 324/378
8,198,827 B2 * 6/2012 Gehman ..... H01H 23/02 307/140
8,760,074 B2 * 6/2014 Raj ..... H05B 33/0869 315/153

OTHER PUBLICATIONS

Philips Advance Brochure, "Design-in guide", Jul. 2014, pp. 1-16.
Texas Instruments Product Data Paper "Floating Switch for Offline AC Linear Direct Drive of LEDs with Low Ripple Current", Oct. 2013, pp. 1-20.
Texas Instruments Paper "TPS92411: Switched Direct Drive Solution for Offline LED Lighting" pp. 1-26.

* cited by examiner

*Primary Examiner* — Haissa Philogene
(74) *Attorney, Agent, or Firm* — Dilworth IP LLC

(57) ABSTRACT

A device and system for controlling a light source. The device has a positive terminal and a negative terminal for setting the high-end trim of a light source, the device includes several zener diodes each having a different zener voltage; and a selector having a plurality of positions, positioning the selector in each of the plurality of positions couples a corresponding one of the zener diodes between the positive terminal and the negative terminal. The cathode of the selected zener diode is coupled to the positive terminal and the anode of the selected zener diode is coupled to the negative terminal. The selected zener diode limits the voltage across the positive terminal and the negative terminal to set the high-end trim of a 0-10 volt lighting control signal.

15 Claims, 7 Drawing Sheets

HIGH-END TRIM CONTROL OF LIGHTING FIXTURES

BACKGROUND

1. Field

This disclosure relates generally to the field of dimming control of light fixtures. More particularly, the disclosure relates to high-end trim adjustment in a dimming controller for light-emitting diode (LED) based light fixtures.

2. Related Art

Light sources may be controlled by a light switch or a dimmer control. A light switch is used to turn a light source on or off. A dimmer control is used to reduce the light emitted by a light source, thereby setting the ambient light intensity to be somewhere between that experienced when the light source is off and that experienced when the light source produces light at full intensity.

Some dimming controls cause drivers to power light emitting diodes (LEDs) at a light intensity that depends on the voltage of a lighting control signal. In some lighting systems, potentiometers are used as a dimmer to set the intensity of the light fixture when it is on.

FIG. 1 illustrates a lighting fixture 102 that is powered through a power line 180 by a power source 101. The lighting fixture 102 includes a light emitting diode (LED) driver 110 that is controlled by a potentiometer 100 and drives an LED array 120. The LED driver 110 receives a 0-10 volt lighting control signal through a control channel 160.

The LED driver 110 drives a current from an internal 10V reference (not shown) through an internal pull-up resistor (not shown) into one terminal of the control channel 160 to the potentiometer 100. The potentiometer 100 has a variable resistance. The potentiometer 100 causes the voltage across the control channel 160 to be between 0 and 10 volts depending on the variable resistance of the potentiometer 100 relative to the resistance of the internal pull-up resistor.

The LED driver 110 drives onto a controlled power line 170 a current that depends on the voltage of the lighting control signal on the control channel 160. The controlled power line 170 powers the LED array 120. The LED array 120 includes one or more LED devices configured to be powered by the controlled power line 170. The light intensity produced by the LED array 120 depends on the lighting control signal.

SUMMARY

Embodiments of the disclosure include components, lighting fixtures and lighting systems that control the light intensity produced by one or more light sources, such as light-emitting diode (LED) arrays. In some embodiments, an LED driver drives an LED array using an output current that increases as a voltage of a 0-10 volt lighting control signal increases from 0 to 10 volts. The LED array receives the output current and produces light with an intensity that depends on the voltage of the lighting control signal.

In some embodiments, a high-end trim control apparatus has a rotary switch that selects one of several zener diodes to be coupled across two lighting control terminals, or selects none of the zener diodes to produce an open circuit across the lighting control terminals.

When the rotary switch is positioned to select none of the zener diodes, a pull-up resistor coupled to a 10 volt reference within the LED driver pulls one of the lighting control terminals to 10 volts. When the voltage across the lighting control terminals is 10 volts, the LED driver drives the LED array at the maximum light intensity. In some embodiments, when the voltage across the lighting control terminals is within the range of 0 to 10 volts, the LED driver drives the LED array to produce a light intensity increasing with increasing voltage as a linear function of the voltage across the control terminals.

When the rotary switch is positioned to select one of the zener diodes, the selected zener diode conducts current in a reverse biased state. The high-end trim control apparatus causes the lighting control signal to be approximately the zener voltage of the selected zener diode. Each of the zener diodes has a different zener voltage between 0 and 10 volts. When the lighting control signal is less than 10 volts, the driver drives the LED array at less than full light intensity. When the rotary switch is positioned to select a zener diode with a higher zener voltage, the LED driver drives the LED array to produce a higher light intensity. When the rotary switch is positioned to select a zener diode with a lower zener voltage, the LED driver drives the LED array to produce a lower light intensity.

In some embodiments, a light switch controls whether power is supplied to the lighting fixture including a high-end trim control apparatus, driver and LED array. When the light switch is off, the driver does not drive power to the LED array such that light is not generated by the LED array. When the light switch is on, the driver drives the LED array to generate a light intensity based on the voltage across the lighting control terminals. The voltage across the lighting control terminals depends on whether a zener diode is selected, and if a zener diode is selected, the zener voltage of the selected zener diode.

In other embodiments, a dimmer control is also coupled across the lighting control terminals having a variable resistance depending on a user control such as a knob or slider (not shown). When a zener diode is not selected, the dimmer control can control the lighting control signal without restriction by the high-end trim control based on a voltage divider relationship with the internal pull-up resistor of the LED driver. When a zener diode is selected, and the variable resistance of the dimmer control is small enough that the voltage across the selected zener diode is below the zener voltage, the selected zener diode is off and the driver drives the LED array according to the voltage determined by the voltage divider relationship between the internal pull-up resistor and the variable resistance of the dimmer control. When the variable resistance of the dimmer is large enough that the selected zener diode turns on, the selected zener diode sinks sufficient current to keep the voltage across the lighting control terminals at approximately the zener voltage of the selected zener diode even as the variable resistance continues to increase. Thus, the voltage range of the lighting control signal is limited by the selected zener diode. The selected zener diode limits the maximum light intensity of the LED array even when the dimmer control knob is positioned such that it would otherwise cause the driver to drive the LED array at the maximum intensity of the LED array.

In some situations, a person may want to equalize the light intensity of two independently controlled light fixtures. Potentiometers can vary resistance to provide for finely tuned adjustments within a particular resistance range, but someone may have to visually estimate the comparative light intensity of two independently controlled light fixtures when trying to set the corresponding potentiometers to the same level. This may lead to variations in intensity that may be perceptible and distracting to others. Alternatively, a technician may need to be called in to measure the light intensity for each fixture using a light meter and adjusting each potentiometer accordingly to equalize the light intensity of multiple potentiometer-controlled light fixtures. In some embodiments, people can reliably and quickly equalize the high end trim of two or more independently controlled light fixtures by selecting a zener diode with the same zener voltage for each light fixture.

Reference in this specification to "one embodiment" or "an embodiment" means that a particular feature, structure, characteristic, advantage or benefit described in connection with the embodiment is included in at least one embodiment of the disclosure, but may not be exhibited by other embodiments. The appearances of the phrase "in one embodiment" in various places in the specification are not necessarily all referring to the same embodiment, nor are separate or alternative embodiments mutually exclusive of other embodiments. Similarly, various requirements are described which may be requirements for some embodiments but not for other embodiments. The specification and drawings are to be regarded in an illustrative sense rather than a restrictive sense. Various modifications may be made thereto without departing from the spirit and scope as set forth in the claims.

DETAILED DESCRIPTION

The following description and drawings are illustrative and are not to be construed as limiting. Numerous specific details are described to provide a thorough understanding of the disclosure. However, in certain instances, well known or conventional details are not described in order to avoid obscuring the description.

Figure 1:
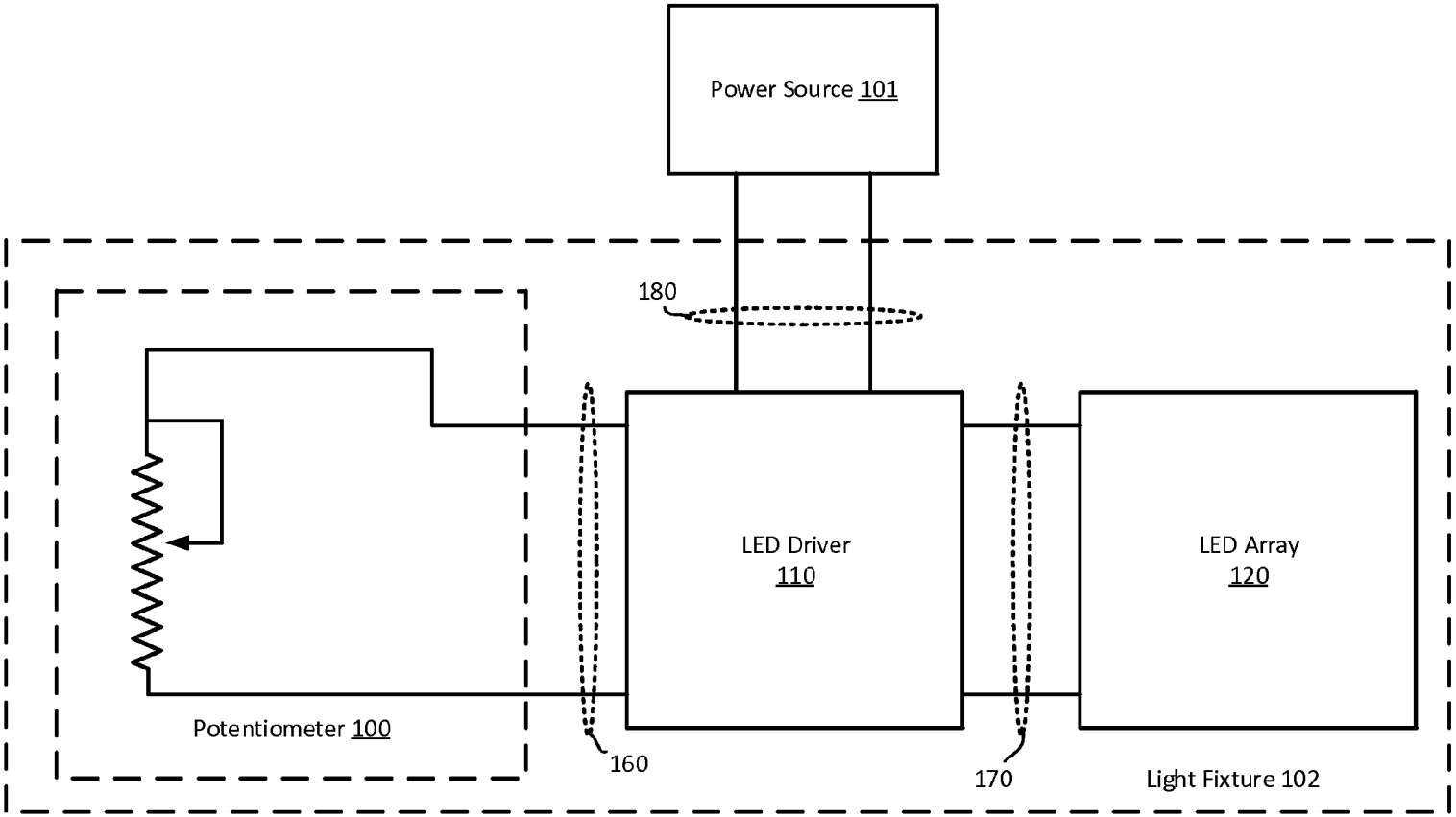
FIG. 1 (Prior Art)
FIG. 1 is a diagram of one embodiment of a prior art light fixture using a potentiometer.
Figure 2:
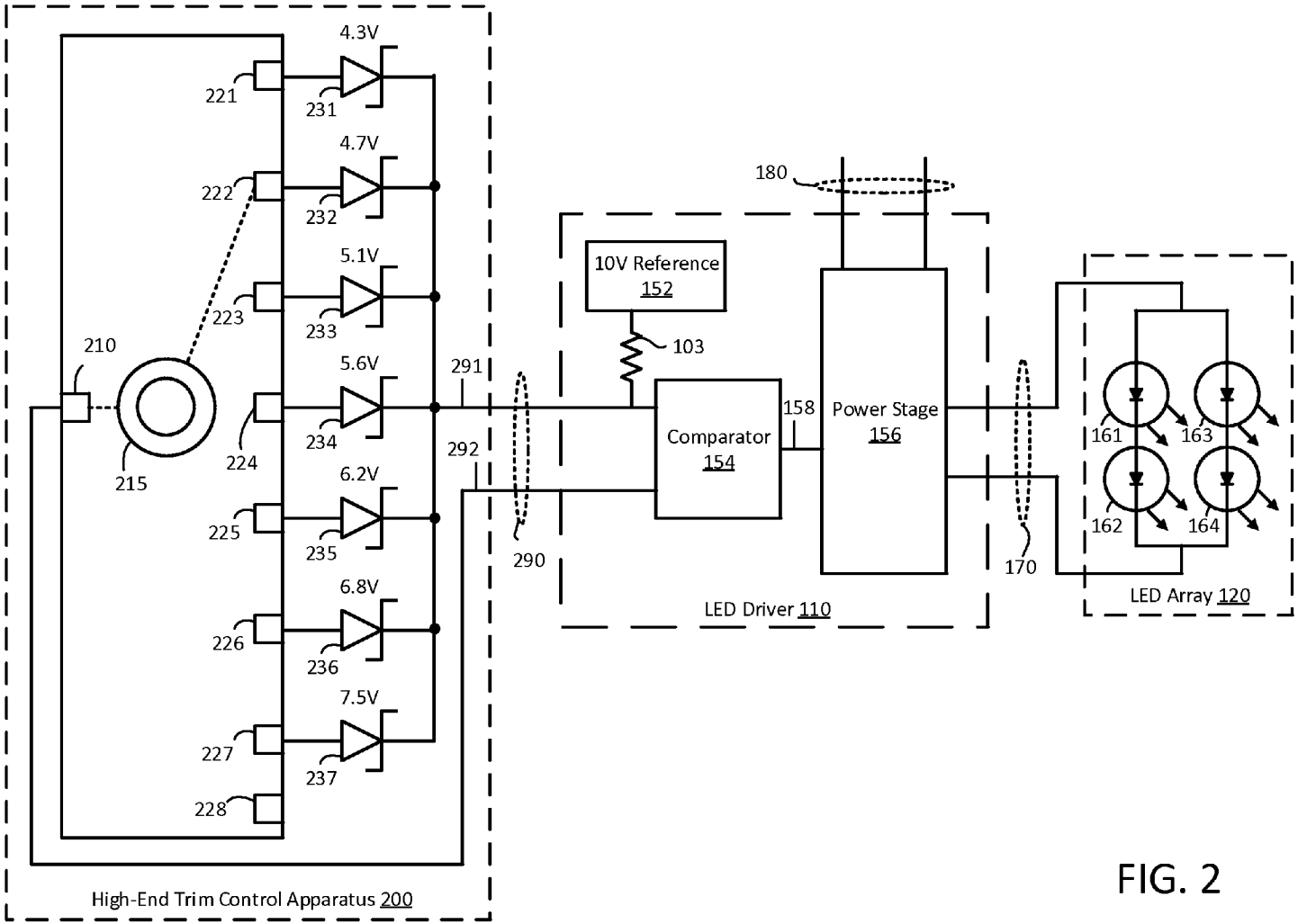
FIG. 2 is a diagram of one embodiment of a light fixture including a high-end trim control apparatus.

FIG. 2 illustrates one embodiment of a light fixture using a high-end trim control apparatus 200.

The high-end trim control apparatus 200 includes a selector 215 that selectively couples a terminal 210 to one of a terminal 221, a terminal 222, a terminal 223, a terminal 224, a terminal 225, a terminal 226, a terminal 227, and a terminal 228. The dotted lines between the terminal 210 and the terminal 222 illustrates that the selector 215 is positioned to electrically couple the terminal 210 to the terminal 222, but the selector 215 may be positioned to electrically couple any one of the terminals 221-228 to the terminal 210. In some embodiments, the selector 215 is a rotary switch that can select any one the terminals 221-228. In other embodiments, the selector 215 includes one or more toggle switches that select between multiple terminals. Other types of mechanical and electrical devices can be used as the selector 215 to selectively couple the terminal 210 to one of the terminals 221-228. It will be apparent to one skilled in the art that the selector 215 may be configured to selectively connect to one of a different number of zener diodes and that other zener voltages may be used.

The high-end trim control apparatus 200 includes seven zener diodes. Each zener diode has an anode and a cathode. When the voltage at the anode is greater than the voltage at the cathode the zener diode is forward biased. When the voltage at the cathode is greater than the voltage at the anode, the zener diode is reverse biased. In a preferred embodiment, the zener diodes are oriented in the high-end trim control apparatus 200 to be reverse biased when selected by the selector 215.

The terminal 221 is coupled to the anode of a zener diode 231 having a zener voltage of 4.3 volts. The terminal 222 is coupled to the anode of a zener diode 232 having a zener voltage of 4.7 volts. The terminal 223 is coupled to the anode of a zener diode 233 having a zener voltage of 5.1 volts. The terminal 224 is coupled to the anode of a zener diode 234 having a zener voltage of 5.6 volts. The terminal 225 is coupled to the anode of a zener diode 235 having a zener voltage of 6.2 volts. The terminal 226 is coupled to the anode of a zener diode 236 having a zener voltage of 6.8 volts. The terminal 227 is coupled to the anode of a zener diode 237 having a zener voltage of 7.5 volts. The terminal 228 is not coupled to a zener diode.

The cathodes of each of the zener diodes 231-237 are coupled together and coupled to the terminal 291. The terminal 210 is coupled to the terminal 292. A control channel 290 includes the terminal 291 and the terminal 292.

A light-emitting diode (LED) driver 110 includes a ten-volt (10V) source 152, a resistor 103, a comparator 154 and a power stage 156. The LED driver 110 receives power from a power source (not shown) over a power line 180. The 10V reference 152 and other components in the LED driver 110 may be directly or indirectly powered by the power source. In some embodiments, power can be supplied according to one of many residential and commercial power standards for power lines or for battery-based power sources.

The comparator 154 receives the lighting control signal on the control channel 290. The terminal 291 is generally at a higher voltage than the terminal 292 such that it causes any connected zener diode to be reverse biased. For this reason, the terminal 291 may be referred to as a positive terminal and the terminal 292 may be referred to as a negative terminal.

The 10V reference 152 is coupled to the terminal 291 through the resistor 103. When the selector 215 selects the terminal 228, an open circuit is created between the terminal 291 and the terminal 292 and the resistor 103 pulls the terminal 291 to 10 volts.

When the selector 215 selects one of the zener diodes, it causes a current to flow from the 10V reference 152 through the resistor 103 and the selected zener diode. The zener diode is reverse biased at roughly its zener voltage ($V_z$) relatively independent of current so that sufficient current flows to cause the voltage drop across the resistor 103 to be about 10-$V_z$ volts. For example, when the terminal 222 is selected, the voltage across the zener diode 232 is about 4.7 volts and the voltage across the resistor 103 is about 5.3 volts. If the resistor 103 has a 1 kilo-ohm resistance, the current that flows when the zener diode 252 is selected is about 5.3 milliamps (mA). Thus, the voltage across the terminal 291 and the terminal 292 is set by the zener voltage of the selected zener diode. Power consumption used for generating the lighting control voltage is about 0-10 milliwatts (mW), depending on the zener voltage of the selected zener diode.

The comparator 154 receives the lighting control signal on the control channel 290 and drives a comparator output signal on a control channel 158 based on the lighting control signal. The power stage 156 receives the comparator output signal on the control channel 158. The power stage 156 drives an output current on a controlled power line 170 based on the comparator output signal.

An LED array 120 receives the output current on the controlled power line 170. The LED array 120 includes an LED 161 and an LED 162 in series, in parallel with an LED 163 and an LED 164 in series. The LEDs are powered by the controlled power line 170 and produce light of an intensity that depends on the output current on the controlled power line 170. LED arrays having a broad range of characteristics in terms of the number of LEDs, arrangement of LEDs, color and electrical characteristics, including power, voltage and current requirements, may be used.

In some embodiments, the high-end trim control apparatus 200 is implemented with LED drivers that are specified to receive a lighting control signal according to a 0-10 volt lighting control standard accepted by LED drivers from several manufacturers. By working with the 0-10 volt lighting control standard, embodiments of the high-end trim control apparatus may be deployed to interface with LED drivers from different manufacturers and be used in conjunction with existing LED lighting fixtures and existing LED lighting systems.

In some embodiments, the terminal 291 is color coded in purple and the terminal 292 is color coded in gray according dimmer control wiring standards to provide a visual cue so that installers may reliably connect the high-end trim control apparatus 200 and the LED driver 110 with the correct polarity across the control channel 290. However, other LED drivers, lighting control signal specifications, and color coding schemes may be used.

Figure 3A:
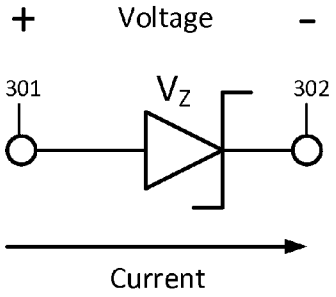
FIG. 3A is a diagram of one embodiment of a zener diode.

FIG. 3A is a diagram of a zener diode having a zener voltage of $V_z$ volts, a voltage across the anode 301 and the cathode 302 of the zener diode, and a current through the zener diode.

Figure 3B:
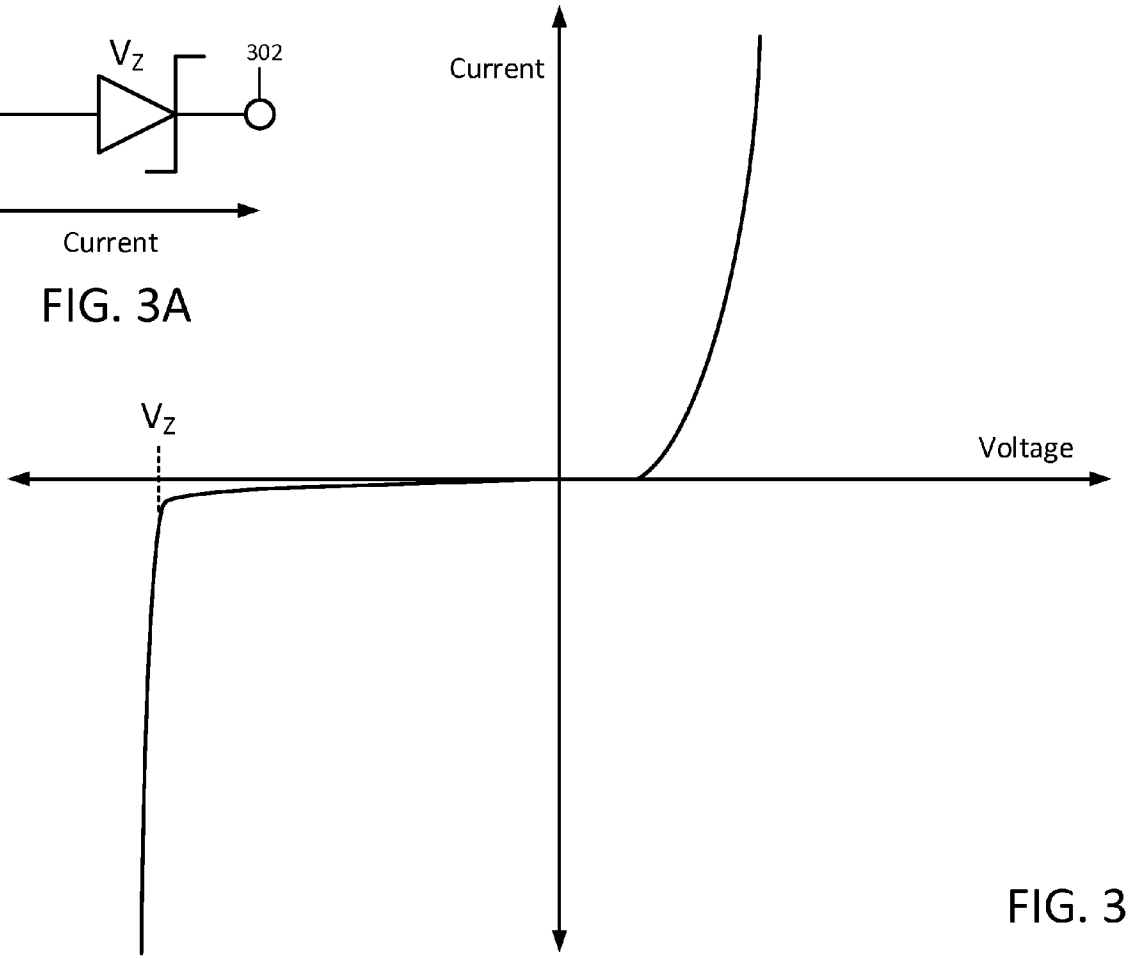
FIG. 3B is a plot of the relationship between current and voltage across the zener diode of FIG. 3A.

FIG. 3B is a plot of current through the zener diode of FIG. 3A in relation to the voltage across the zener diode. When the voltage is positive, the zener diode is forward biased and turns on when the voltage exceeds a turn-on voltage of the zener diode. When the voltage of the cathode exceeds the voltage of the anode, the zener diode is reverse biased and turns on when the reverse biased voltage reaches about $V_z$ volts. As the reverse-biased current increases, the reverse biased voltage remains at approximately $V_z$ volts.

Figure 4:
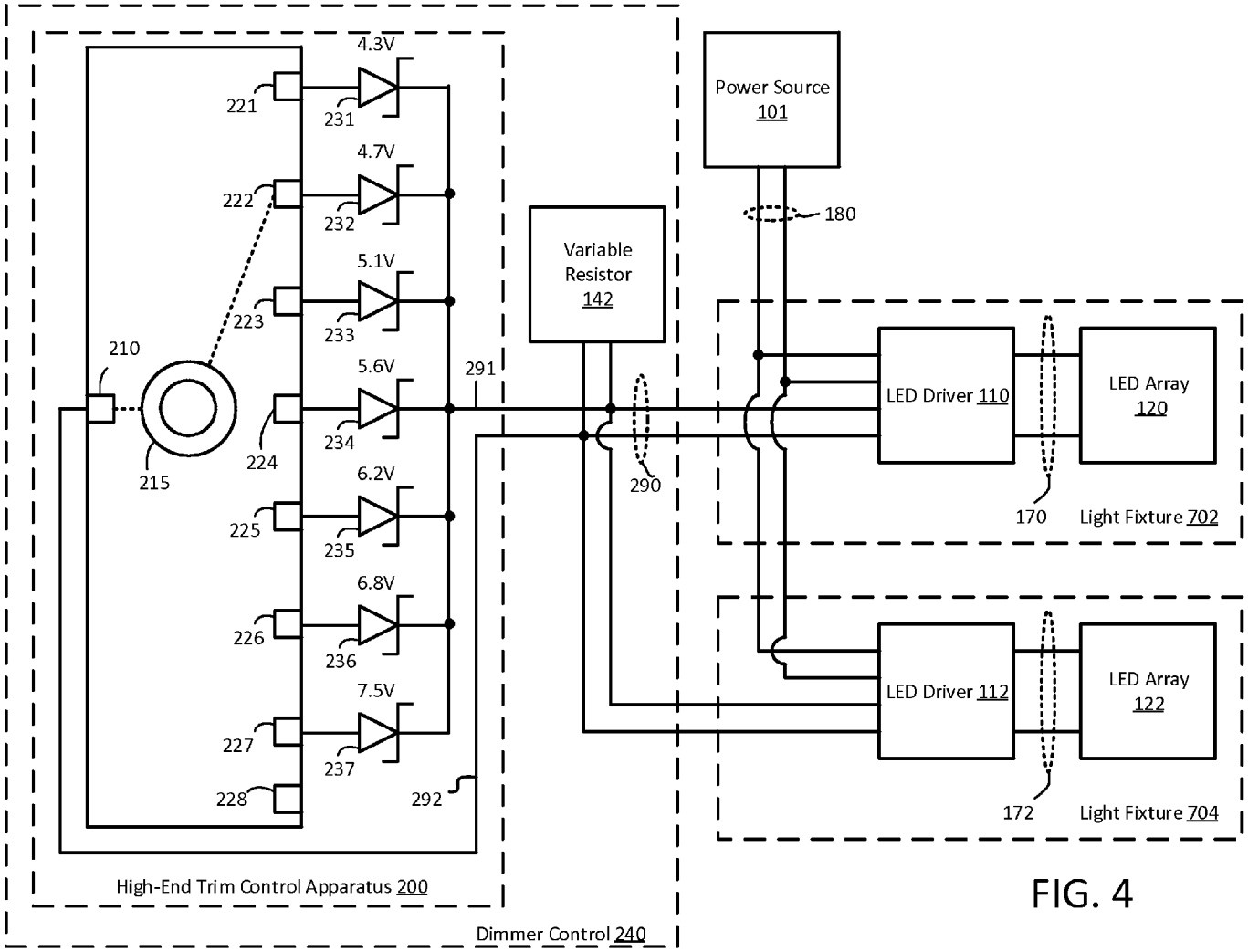
FIG. 4 is a diagram of one embodiment of a lighting system including a high-end trim control apparatus and a dimmer control.

FIG. 4 illustrates an embodiment of a lighting system having a dimmer control 240 including a variable resistor 142 and the high-end trim control apparatus 200. The dimmer control 240 is coupled to the control channel 290. In some embodiments, the dimmer control 240 is mounted on a wall.

In some embodiments, the dimmer control 240 has a variable resistor 142 that depends on a user control such as a user-adjustable position of a rotatable knob or linearly sliding handle (not shown).

In some embodiments, the variable resistor 142 may be controlled using other mechanical or electrical devices. In some embodiments, the selector 215 and the user control are both easily accessible on the external part of the dimmer control 240. In other embodiments, the selector 215 is less accessible on the internal part of the dimmer control 240 to provide a high-end limit on the light intensity range produced by the user control.

The power source 101, the LED driver 110, the LED driver 112, the LED array 120 and the LED array 122 are similar to the power source, the LED driver and the LED array described with reference to FIG. 2.

A light fixture 702 includes the LED driver 110 coupled to receive power from the power source 101 on the power line 180 and the lighting control signal on the control channel 290. Similarly, a light fixture 704 includes the LED driver 112 coupled to receive power from the power source 101 on the power line 180 and coupled to receive the lighting control signal on the control channel 290.

The LED driver 110 drives a current on the controlled power line 170 based on the lighting control signal to power the LED array 120. The LED driver 112 drives a current on the controlled power line 172 based on the lighting control signal to power the LED array 122.

When the selector 215 selects the terminal 228 to create an open circuit on the control channel 290, the dimmer control 240 controls the lighting control signal on the control channel 290 without restriction by the high-end trim control apparatus 200. The lighting control signal is generated as a fraction of the 10V reference voltage based on a voltage divider relationship between the variable resistor 142 of the dimmer control 240 and the parallel pull-up resistors to each 10V reference in the LED driver 110 and the LED driver 112. The LED driver 110 drives an output current on a controlled power line 170 based on the lighting control signal on the control channel 290. The LED driver 112 drives an output current on a controlled power line 172 based on the same lighting control signal on the control channel 290. Thus, the LED array 120 and the LED array 122 generate light intensity corresponding to the lighting control signal controlled by the variable resistor 142 of the dimmer control 240.

When the selector 215 selects one of the zener diodes, the selected zener diode is coupled across the control channel 290. When the variable resistor 142 has a resistance that causes the voltage across the selected zener diode to be less than the zener voltage according to the voltage divider relationship, the selected zener diode is off and the lighting control signal is determined by the voltage divider relationship described above with reference to the scenario where none of the zener diodes are selected.

When the variable resistor 142 has a resistance that causes the lighting control signal to reach the zener voltage of the selected zener diode, the zener diode reaches reverse breakdown and sinks current to maintain the voltage across the control channel 290 at approximately the zener voltage of the selected zener diode as the variable resistance continues to increase up to the point where the lighting control signal would be at full-intensity had none of the zener diodes been selected. Thus, the lighting control signal is limited by the zener voltage of the selected zener diode. The light intensity of the LED array 120 and the LED array 122 are limited due to the limited range of the lighting control signal.

In some embodiments, the high-end trim control apparatus 200 is coupled to LED drivers that use 0-10V references without pull-up resistors.

The maximum power rating of the zener diodes should be sufficient to accommodate the maximum current that the zener diodes will sink given the electrical characteristics of the dimmer control 240, and the electrical characteristics and number of LED drivers on the control channel 290. In some embodiments, four or more LED drivers are coupled to receive the lighting control signal on the control channel 290.

Figure 5:
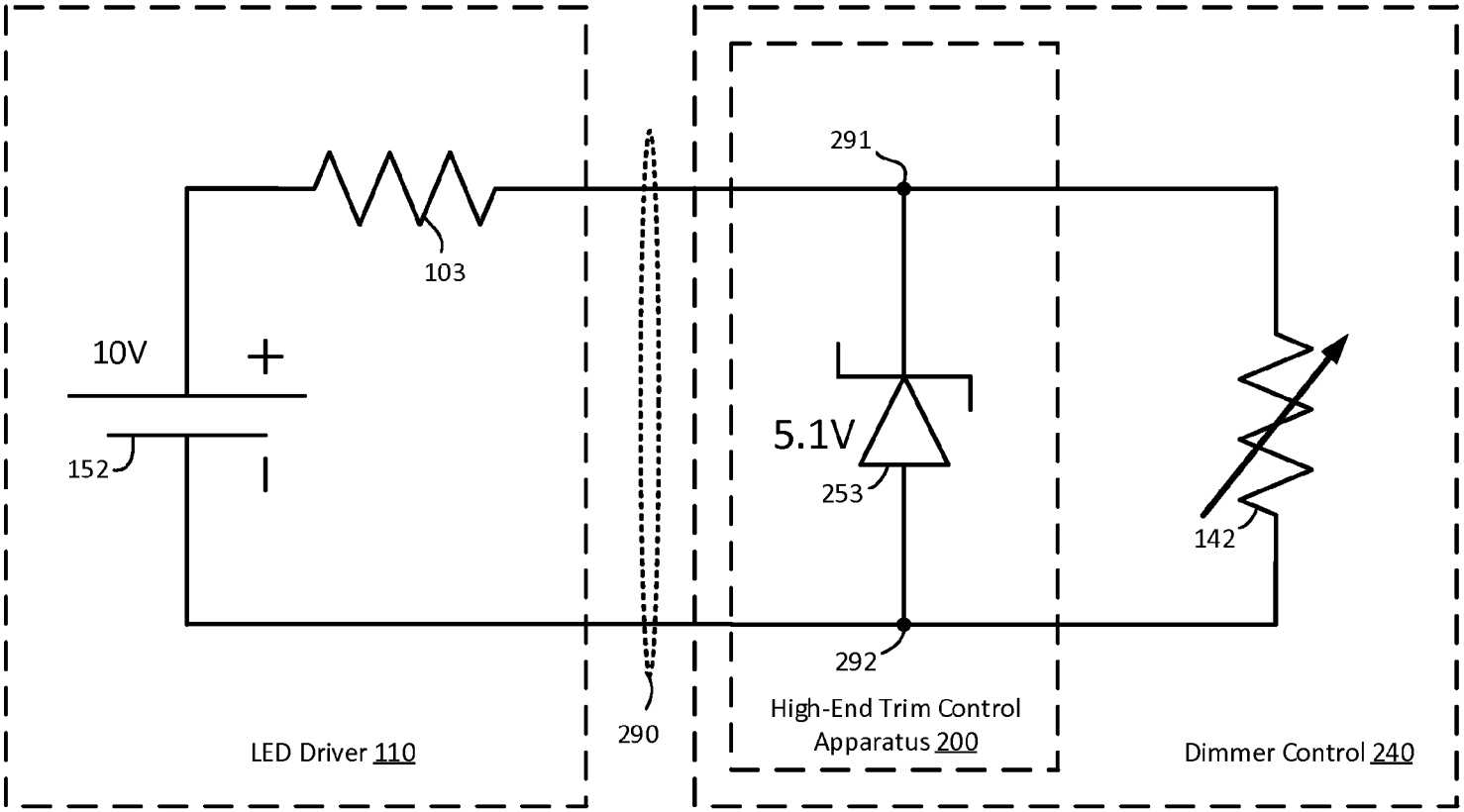
FIG. 5 is a simplified circuit diagram of one embodiment of an LED driver, high-end trim control apparatus, and a dimmer control.

FIG. 5 shows one embodiment of a simplified circuit model of the control channel 290 with an LED driver 110, a high-end trim control apparatus 200 and a dimmer control 240. The model shows how the lighting control signal across the control channel 290 is generated but does not show the comparator circuitry that responds to the voltage across the control channel 260.

The LED driver 110 has a 10V reference 152 and a resistor 103 in series. The dimmer control 240 changes a variable resistance across the control channel 290 depending on the position of a dimmer control knob or handle (not shown).

When the high-end trim control apparatus 200 does not select a zener diode (modeled by removing the zener diode 253 from the circuit model shown in FIG. 5), the lighting control signal is generated as a fraction of the voltage of the 10V reference 152 based on a voltage divider relationship between the resistance of the variable resistor 142 of the dimmer control 240 and the resistor 103 within the LED driver 110.

When the selector selects one of the zener diodes as described with reference to FIG. 2, the selected zener diode is coupled across the control channel 290. FIG. 5 shows that the high-end trim apparatus 240 has the zener diode 253 coupled across the control channel 290, but other zener diodes may be selected and similarly modeled. The zener diode 253 has a zener voltage of 5.1 volts.

When the variable resistor 142 has a resistance that is low enough, the zener diode 253 is off (in some embodiments with some leakage current) and the voltage across the control channel 290 is determined by the voltage divider relationship between the variable resistor 142 and the resistor 103 as described above in the scenario where none of the zener diodes are selected.

When the resistance of the variable resistor 142 is increased to the point that the voltage across the zener diode 253 reaches the zener voltage of 5.1 volts, the zener diode turns on in reverse breakdown and begins to sink current. As the resistance of the variable resistor 142 increases from that point, the zener diode 253 maintains the voltage across the control channel 260 at about the zener voltage of 5.1 volts.

In one embodiment, the resistance of the resistor 103 is 1000 ohms. When the resistance of the variable resistor 142 is increased to about 1040 ohms, the voltage divider relationship causes the voltage at the terminal 291 to be about 5.1 volts, causing the zener diode 253 to turn on. As the voltage of the variable resistor 142 continues to increase, the zener diode 253 sinks more current so that the current pulled through the resistor 103 by the variable resistor 142 and the zener diode 253 operating in parallel causes the voltage drop across the resistor 103 to maintain the terminal 291 at the zener voltage of the zener diode 253.

The LED driver 110 drives an output current on a controlled power line (not shown) having a magnitude that is dependent on the lighting control signal on the control channel 290. Thus, the LED array (not shown) generates light intensity corresponding to the lighting control signal.

Figure 6A:
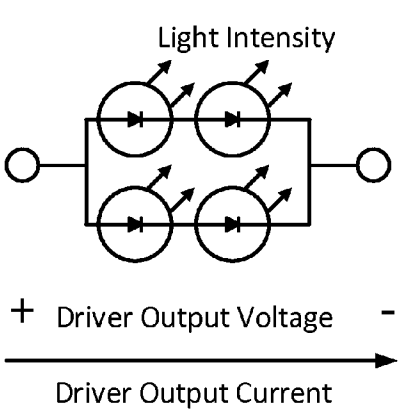
FIG. 6A is a diagram of an LED array.
Figure 6B:
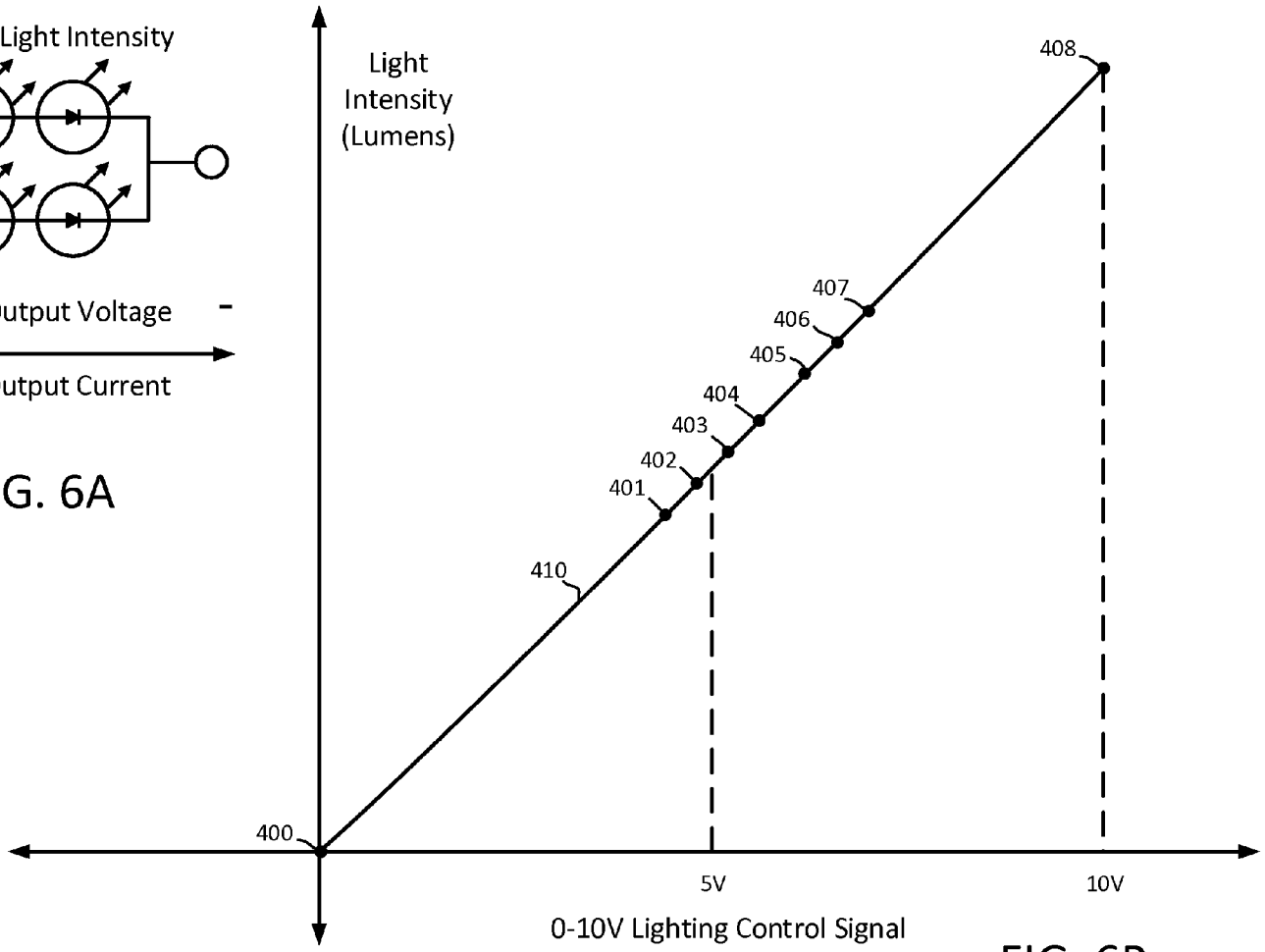
FIG. 6B is one embodiment of a plot of the relationship between a 0-10V control signal input to a driver of the LED array shown in FIG. 2A, and the light intensity of the LED array.

FIG. 6A shows an embodiment of an LED array receiving a driver output voltage and a driver output current. FIG. 6B is a plot showing one embodiment of light intensity of the LED array of FIG. 6A as a function of voltage of the 0-10 volt lighting control signal—a line 410. As the voltage of the lighting control signal increases, the driver output current through the LED array increases, and the intensity of the light generated increases.

When the LED array is driven by the light fixture of FIG. 2, the selected zener diode sets the 0-10 volt lighting control signal to a voltage less than 10 volts—approximately the zener voltage of the selected zener diode—thereby causing the light intensity to be less than the maximum intensity at a point 408 on the line 410. In one embodiment, the light intensity with a lighting control signal at 5 volts is about half the light intensity with a lighting control signal at 10 volts. However, in other embodiments, the line 410 may have a less linear relationship to the voltage of the lighting control signal. By selecting zener diodes with different zener voltages between 0 and 10 volts, the light intensity of the LED array can vary between off at a point 400 and full intensity at the point 408.

In a lighting system without a dimmer control, the lighting fixture operates at a point 401 on the line 410 when the zener diode 281 is selected. In a lighting system including the dimmer control 240, the lighting fixture operates between the point 400 and the point 401 on the line 410 depending on the variable resistance of the dimmer control 240. As the variable resistance increases, the light intensity increases up to the limit set by the zener diode 281.

In a lighting system without a dimmer control, the lighting fixture operates at a point 402 on the line 410 when the zener diode 282 is selected. In a lighting system including the dimmer control 240, the lighting fixture operates between a point 400 and the point 402 on the line 410 depending on the variable resistance of the dimmer control 240. As the variable resistance increases, the light intensity increases up to the limit set by the zener diode 282.

In a lighting system without a dimmer control, the lighting fixture operates at a point 403 on the line 410 when the zener diode 283 is selected. In a lighting system including the dimmer control 240, the lighting fixture operates between a point 400 and the point 403 on the line 410 depending on the variable resistance of the dimmer control 240. As the variable resistance increases, the light intensity increases up to the limit set by the zener diode 283.

In a lighting system without a dimmer control, the lighting fixture operates at a point 404 on the line 410 when the zener diode 284 is selected. In a lighting system including the dimmer control 240, the lighting fixture operates between a point 400 and the point 404 on the line 410 depending on the variable resistance of the dimmer control 240. As the variable resistance increases, the light intensity increases up to the limit set by the zener diode 284.

In a lighting system without a dimmer control, the lighting fixture operates at a point 405 on the line 410 when the zener diode 285 is selected. In a lighting system including the dimmer control 240, the lighting fixture operates between a point 400 and the point 405 on the line 410 depending on the variable resistance of the dimmer control 240. As the variable resistance increases, the light intensity increases up to the limit set by the zener diode 285.

In a lighting system without a dimmer control, the lighting fixture operates at a point 406 on the line 410 when the zener diode 286 is selected. In a lighting system including the dimmer control 240, the lighting fixture operates between a point 400 and the point 406 on the line 410 depending on the variable resistance of the dimmer control 240. As the variable resistance increases, the light intensity increases up to the limit set by the zener diode 286.

In a lighting system without a dimmer control, the lighting fixture operates at a point 407 on the line 410 when the zener diode 287 is selected. In a lighting system including the dimmer control 240, the lighting fixture operates between a point 400 and the point 407 on the line 410 depending on the variable resistance of the dimmer control 240. As the variable resistance increases, the light intensity increases up to the limit set by the zener diode 287.

In a lighting system without a dimmer control, the lighting fixture operates at a point 408 on the line 410 when none of the zener diodes are selected. In a lighting system including the dimmer control 240, the lighting fixture operates between a point 400 and the point 408 on the line 410 depending on the variable resistance of the dimmer control 240. As the variable resistance increases, the light intensity increases up to the maximum light intensity at the point 408 without restriction by any of the zener diodes.

The selected zener diode limits the high-end of the range of the lighting control signal, but has no effect on the operating points of the dimmer control 240 below that limit. On the other hand, if a potentiometer is used in place of the zener diode, the operating points of the dimmer control 240 would shift throughout the range of the lighting control signal. This is important in embodiments where a set point of the variable resistor 142 is at a minimum required light level. If a zener diode is then applied in combination with the variable resistor, it scales back the maximum light intensity while leaving the minimum light intensity unmodified. However, if a potentiometer is used in place of the zener diode, the minimum light level is also scaled back when the potentiometer is applied in combination with the variable resistor. That may lead to inadequate light intensity.

Although the high-end trim control apparatus 200 is described with reference to a standard 0-10 volt controlled LED driver, other embodiments may use other voltage-controlled driver input specifications within different voltage ranges and different light intensity responses over the specified voltage range.

Figure 7:
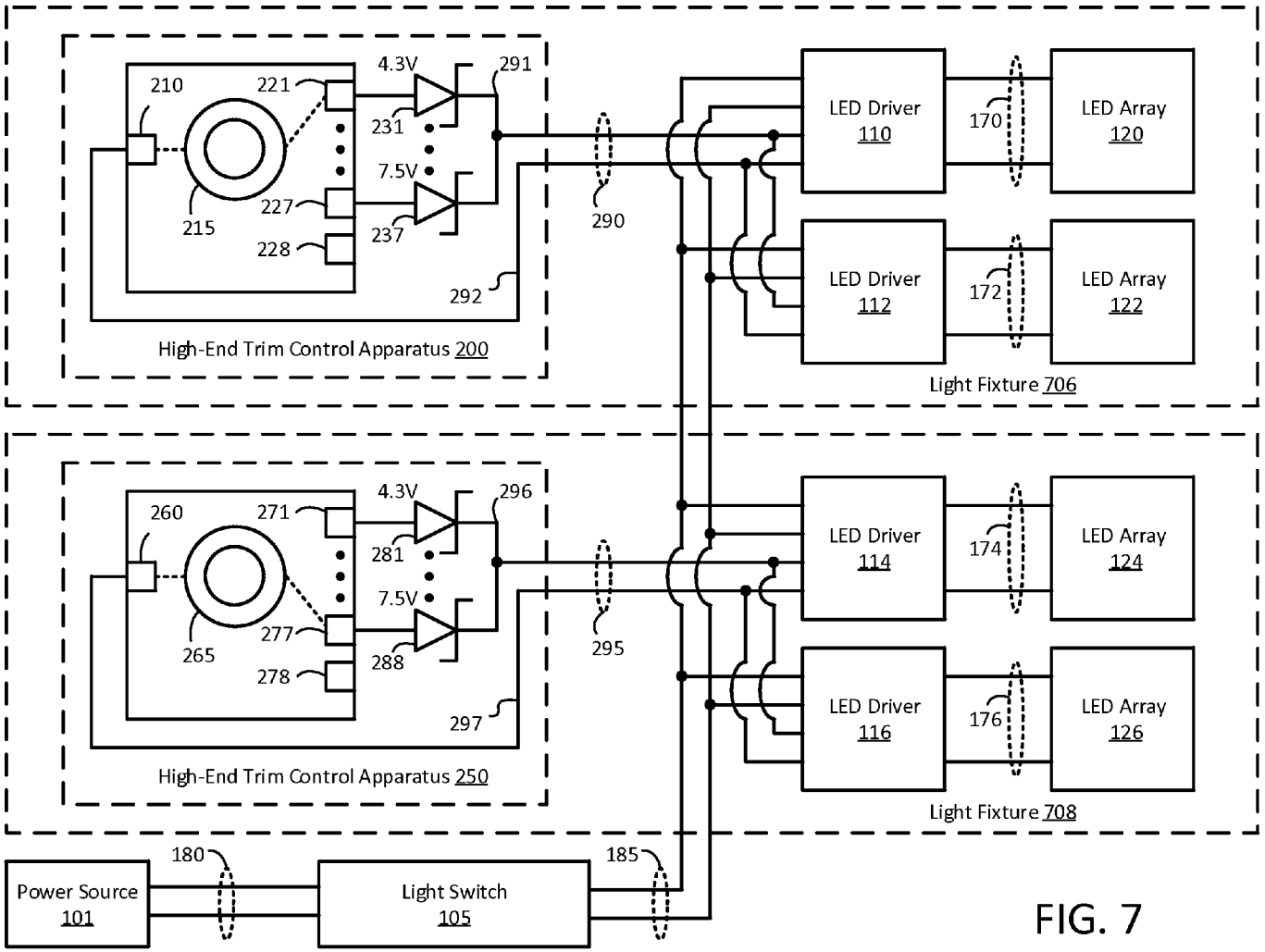
FIG. 7 is a diagram of one embodiment of a lighting system having multiple light fixtures each including a high-end trim control apparatus.

FIG. 7 illustrates a lighting system having multiple light fixtures each controlled by a high-end trim control apparatus coupled to a light fixture having two LED drivers driving LED arrays.

The high-end trim control apparatus 200 shown here is described with reference to FIG. 2. Only the first and last of the terminals 221-227 and the first and last of the zener diodes 231-237 are shown in this figure. The selector 215 selects between the terminals 221-228 to connect one of the zener diodes 231-237 or create an open circuit across the control channel 290. The high-end trim control apparatus 200 is coupled through the control channel 290 to the LED driver 110 and an LED driver 112.

The high-end trim control apparatus 250 shown here is similar to the high-end trim control apparatus 250 described with reference to FIG. 2. Only the first and last of the terminals 271-277 and the first and last of the zener diodes 281-287 are shown in this figure. The selector 215 selects between the terminals 271-278 to connect one of the zener diodes 281-287 or create an open circuit across a control channel 295. The high-end trim control apparatus 200 is coupled through the control channel 295 to the LED driver 114 and an LED driver 116.

A power source 101 provides power on the power line 180. A light switch 105 is coupled to the power line 180 and selectively connects the power line 180 to a power line 185 depending on whether the light switch 105 is switched on or switched off. The LED driver 110, the LED driver 112, the LED driver 114 and the LED driver 116 are coupled to the power line 185 and thereby receive power when the light switch 105 is switched on.

When the light switch 105 is switched on, the LED driver 110 driver drives a current on the controlled power line 170 and the LED driver 112 drives a current on the controlled power line 172 according to the lighting control signal on the control channel 290. When the light switch 105 is switched on, the LED driver 114 driver drives a current on the controlled power line 174 and the LED driver 116 drives a current on the controlled power line 176 according to the lighting control signal on the control channel 295.

The LED array 120 is coupled to the controlled power line 170 and the LED array 122 is coupled to the controlled power line 172. The light intensity of the LED array 120 and the LED array 122 is controlled by the lighting control signal on the control channel 290.

The LED array 124 is coupled to the controlled power line 174 and the LED array 126 is coupled to the controlled power line 176. The light intensity of the LED array 124 and the LED array 126 is controlled by the lighting control signal on the control channel 295.

The lighting control signal on the control channel 290 and the lighting control signal on the control channel 295 are independently controlled. When the selector 215, selects the zener diode 231, the lighting control signal on the control channel 290 is about 4.3 volts—the zener voltage of the zener diode 231. When the selector 265 selects the zener diode 287, the lighting control signal on the control channel 295 is about 7.5 volts—the zener voltage of the zener diode 287. Thus, the light fixture 706 and the light fixture 708 will produce different light intensities based on the different lighting control voltages.

One can independently adjust the selector 215 and the selector 265 to independently control the light intensity of the light fixture 706 and the light fixture 708. On the other hand, if one wanted to match the light intensity of the light fixture 706 and the light fixture 708, one might use the selector 215 and the selector 265 to select zener diodes with the same zener voltage. For example, when the selector 215 selects the zener diode 237 and the selector 265 selects the zener diode 288, the lighting control signal on the control channel 290 and the lighting control signal on the control channel 295 will both be 7.5 volts. Thus, both the light fixture 706 and the light fixture 708 will produce a light intensity corresponding to the same lighting control voltage.

In some embodiments, the high-end trim control apparatus 200 is mounted on the light fixture 706 and the selector 215 is adjusted by an installer or technician. In other embodiments, the high-end trim control apparatus 200 is installed remotely from the light fixture 706, such as on a nearby wall, making the selector 215 more easily accessible. The wall-mounted high-end trim control apparatus 200 controls the light fixture 706 using a control channel 290 with a longer wired connection.

In some embodiments, the high-end trim control apparatus 250 is mounted on the light fixture 708 and the selector 265 is adjusted by an installer or technician. In other embodiments, the high-end trim control apparatus 250 is installed remotely from the light fixture 708, such as on a nearby wall, making the selector 265 more easily accessible. The wall-mounted high-end trim control apparatus 250 controls the light fixture 708 using a control channel 295 with a longer wired connection.

When the light switch 105 is switched off, the LED driver 110, the LED driver 112, the LED driver 114 and the LED driver 116 does not receive power on the power line 185. The LED array 120, the LED array 122, the LED array 124 and the LED array 126 does not receive power on the controlled power line 170, the controlled power line 172, the controlled power line 174 and the controlled power line 176, respectively. Thus the light fixture 706 and the light fixture 708 do not produce light when the light switch 105 is switched off.

The maximum power rating of the zener diodes should accommodate the maximum current that the zener diodes will sink given the electrical characteristics and number of LED drivers on the control channel 290 and the control channel 295.

The foregoing specification provides a description with reference to specific exemplary embodiments. The specification and drawings are to be regarded in an illustrative sense rather than a restrictive sense. Various modifications may be made thereto without departing from the spirit and scope as set forth in the following claims.

What is claimed is:

1. An apparatus for controlling a light source, the apparatus comprising:

a driver having a control channel, the driver powers the light source based on a first voltage across the control channel;

a plurality of zener diodes each having a corresponding zener voltage;

a selector is configured to select a selected one of the plurality of zener diodes across the control channel such that the voltage across the control channel is limited by the selected zener diode, the control channel having a positive terminal and a negative terminal, the selected zener diode having an anode and a cathode, the cathode of the selected zener diode being coupled to the positive terminal and the anode of the selected zener diode being coupled to the negative terminal; and a variable resistor across the control channel.

2. The apparatus of claim 1 wherein the light source comprises a light emitting diode.

3. The apparatus of claim 1 wherein the selector is configured to selectively decouple all of the plurality of zener diodes from either the positive terminal or the negative terminal.

4. The apparatus of claim 1 wherein the selector is a rotary switch.

5. A lighting system comprising:

a first light fixture comprising a first driver, the first driver being coupled to a first control channel, the first driver drives power on a first controlled power line based on a voltage across the first control channel, the first control channel having a first positive terminal and a first negative terminal; and a first high-end trim control having a first zener diode, the first zener diode having an anode and a cathode, the cathode of the first zener diode being coupled to the first positive terminal and the anode of the first zener diode being coupled to the first negative terminal, wherein the voltage across the first control channel is limited by the first zener diode.

6. The lighting system of claim 5 further comprising:

a second light fixture comprising:

a second driver coupled to a second control channel, the second driver being configured to drive power on a second controlled power line based on a voltage across a second control channel; and a second high-end trim control having a second zener diode, the second zener diode having an anode and a cathode, the second control channel having a second positive terminal and a second negative terminal, the cathode of the second zener diode being coupled to the second positive terminal and the anode of the second zener diode being coupled to the second negative terminal, wherein the voltage across the second positive terminal and the second negative terminal is limited by the second zener diode.

7. The lighting system of claim 6 wherein the first light fixture further comprises a first LED array coupled to receive power on the first controlled power line and the second light fixture further comprises a second LED array coupled to receive power on the second controlled power line.

8. The lighting system of claim 6 wherein the first high-end trim control further comprises a first selector and the second high-end trim control further comprises a second selector, the first selector selects the first zener diode among a first plurality of zener diodes and the second selector selects the second zener diode among a second plurality of zener diodes.

9. The lighting system of claim 8 wherein each of the first plurality of zener diodes has one of a first plurality of corresponding zener voltages, the first plurality of corresponding zener voltages comprising at least one of 4.3 volts, 4.7 volts, 5.1 volts, 5.6 volts, 6.2 volts, 6.8 volts and 7.5 volts.

10. The lighting system of claim 8 wherein the first high-end trim control selectively decouples from all of the first plurality of zener diodes, wherein the first voltage is not limited by any of the first plurality of zener diodes.

11. The lighting system of claim 5 wherein the first high-end trim control is mounted on the first light fixture.

12. The lighting system of claim 5 further comprising a dimmer control comprising a resistor coupled across the first control channel, the resistor having a variable resistance that depends on a user control, wherein the first high-end trim control is mounted on the dimmer control.

13. The lighting system of claim 12 wherein the user control is a knob or slider.

14. The lighting system of claim 12 further comprising:

a second light fixture comprising a second driver coupled to the power source and the first control channel, the second driver being configured to drive power on a second controlled power line based on the voltage across the first positive terminal and the first negative terminal.

15. The lighting system of claim 14 wherein the first light fixture further comprises a first LED array coupled to receive power on the first controlled power line and the second light fixture further comprises a second LED array coupled to receive power on the second controlled power line.

* * * * *